US009392668B2

(12) United States Patent
Kamoi et al.

(10) Patent No.: US 9,392,668 B2
(45) Date of Patent: Jul. 12, 2016

(54) LIGHTING DEVICE AND LIGHTING FIXTURE

(71) Applicant: Panasonic Corporation, Osaka (JP)

(72) Inventors: Takeshi Kamoi, Kyoto (JP); Hiroshi Kido, Osaka (JP); Akinori Hiramatu, Nara (JP); Junichi Hasegawa, Osaka (JP); Shigeru Ido, Osaka (JP); Nobutoshi Matsuzaki, Osaka (JP); Daisuke Yamahara, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 42 days.

(21) Appl. No.: 14/180,502

(22) Filed: Feb. 14, 2014

(65) Prior Publication Data

US 2014/0232268 A1 Aug. 21, 2014

(30) Foreign Application Priority Data

Feb. 18, 2013 (JP) ..... 2013-029200

(51) Int. Cl.
*H05B 37/02* (2006.01)
*H05B 33/08* (2006.01)

(52) U.S. Cl.
CPC ..... *H05B 33/089* (2013.01); *H05B 33/0854* (2013.01)

(58) Field of Classification Search
CPC ..... H05B 37/0227; H05B 33/089; H05B 33/0803; H05B 33/0854; H05B 37/02
USPC ..... 315/112–118, 309, 291, 246, 307
See application file for complete search history.

(56) References Cited

U.S. PATENT DOCUMENTS

2002/0130786 A1* 9/2002 Weindorf ..... 340/815.45
2006/0202914 A1* 9/2006 Ashdown ..... 345/46
2007/0253132 A1* 11/2007 Nakamura ..... H02H 6/005 361/103
2012/0161633 A1* 6/2012 Nishitani et al. ..... 315/117
2013/0249696 A1* 9/2013 Ikuta ..... H02H 3/085 340/593

FOREIGN PATENT DOCUMENTS

JP 10-312888 A 11/1998
JP 2004-214519 A 7/2004
JP 2004345319 A * 12/2004
JP 2006-147373 A 6/2006
JP 2010-192406 A 9/2010
JP 2010-272472 A 12/2010
JP 2012-009195 A 1/2012

* cited by examiner

*Primary Examiner* — Tuyet Vo
*Assistant Examiner* — Amy Yang
(74) *Attorney, Agent, or Firm* — Renner, Otto, Boisselle & Sklar, LLP

(57) ABSTRACT

The lighting device according to the present invention includes a power supply circuit, a temperature detection circuit, and a temperature control circuit. The power supply circuit supplies operation power to a light source including a solid state light emitting device. The temperature detection circuit measures a surrounding temperature of the light source and outputs the measured surrounding temperature as a detection temperature. The temperature control circuit determines whether an increase rate of the surrounding temperature exceeds a predetermined criterion value. When determining that the increase rate exceeds the criterion value, the temperature control circuit performs a process of decreasing a temperature of the light source.

14 Claims, 14 Drawing Sheets

LIGHTING DEVICE AND LIGHTING FIXTURE

TECHNICAL FIELD

The present invention relates to lighting devices and lighting fixtures using the same, and particularly to a lighting device for solid state light emitting devices such as light emitting diodes and a lighting fixture using the same.

BACKGROUND ART

In the past, there has been proposed a device configured to suppress an excess increase in a temperature of a light emitting diode (hereinafter referred to as "LED") when operated, so as to keep it in a stable state, in order to stabilize a light output and a lifetime of the LED. For example, such a device is disclosed in document 1 (Japanese Unexamined Patent Application Publication No, 2010-272472).

An LED lighting apparatus disclosed in document 1 includes a lighting body and a liquid-cooled heat dissipation mechanism. The lighting body includes an LED light source, a temperature detection device, and a water-cooling jacket for cooling the LED light source. The liquid-cooled heat dissipation mechanism cools, by use of a radiator, a liquid coolant which absorbs heat from the LED light source when passing through the water-cooling jacket. With regard to this LED lighting apparatus, in the lighting body, to suppress an excess increase in the temperature of the LED light source when operated, the LED light source is operated by use of a control current corresponding to a detection temperature from the temperature detection device.

However, in the above prior art, when the LED light source operates abnormally for example, there is a possibility that the detection temperature deviates from an actual temperature by more than an allowable value. In this case, it is hard to adjust the temperature of the solid state light emitting device appropriately, and therefore the temperature of the solid state light emitting device is likely to exceed an allowable temperature of the solid state light emitting device. This may disadvantageously cause deterioration of a light emitting efficiency and shorten a lifetime of the solid state light emitting device.

SUMMARY OF INVENTION

The present invention has aimed to propose a lighting device capable of suppressing an increase in a temperature of a solid state light emitting device to avoid that the temperature of the solid state light emitting device exceeds an allowable temperature, and a lighting fixture using the same.

The lighting device of the first aspect in accordance with the present invention includes a power supply circuit, a temperature detection circuit, and a temperature control circuit. The power supply circuit is configured to supply operation power to a light source including a solid state light emitting device. The temperature detection circuit is configured to measure a surrounding temperature of the light source and output the measured surrounding temperature as a detection temperature. The temperature control circuit is configured to determine whether an increase rate of the surrounding temperature exceeds a predetermined criterion value. The temperature control circuit is configured to, when determining that the increase rate exceeds the criterion value, perform a process of decreasing a temperature of the light source.

According to the lighting device of the second aspect in accordance with the present invention, in addition to the first aspect, the temperature control circuit is a control circuit configured to control the power supply circuit. The temperature control circuit is configured to, in the process, decrease the operation power.

According to the lighting device of the third aspect in accordance with the present invention, in addition to the second aspect, the temperature control circuit is configured to, in the process, determine the operation power according to a magnitude of the increase rate.

According to the lighting device of the fourth aspect in accordance with the present invention, in addition to the third aspect, the temperature control circuit is configured to, in the process, decrease the operation power as the increase rate increases.

According to the lighting device of the fifth aspect in accordance with the present invention, in addition to the first aspect, the lighting device further includes a cooler configured to cool the light source. The temperature control circuit is a drive circuit configured to control drive power supplied to the cooler. The cooler has cooling capacity increasing with an increase in a magnitude of the drive power. The temperature control circuit is configured to, in the process, increase the drive power.

According to the lighting device of the sixth aspect in accordance with the present invention, in addition to the fifth aspect, the temperature control circuit is configured to, in the process, determine the drive power according to a magnitude of the increase rate.

According to the lighting device of the seventh aspect in accordance with the present invention, in addition to the sixth aspect, the temperature control circuit is configured to, in the process, increase the drive power as the increase rate increases.

According to the lighting device of the eighth aspect in accordance with the present invention, in addition to any one of the first to seventh aspects, the power supply circuit is configured to regulate a magnitude of the operation power to a desired value to turn on the light source. The temperature control circuit is configured to determine the criterion value according to the desired value.

According to the lighting device of the ninth aspect in accordance with the present invention, in addition to the eighth aspect, the temperature control circuit is configured to decrease the criterion value as the desired value decreases.

According to the lighting device of the tenth aspect in accordance with the present invention, in addition to any one of the first to seventh aspects, the temperature control circuit is configured to calculate required time necessary for the detection temperature to reach a second threshold from a first threshold when supply of the operation power from the power supply circuit to the light source is started. The temperature control circuit is configured to determine that the increase rate exceeds the criterion value when the required time is not greater than predetermined criterion time.

According to the lighting device of the eleventh aspect in accordance with the present invention, in addition to the tenth aspect, the power supply circuit is configured to regulate a magnitude of the operation power to a desired value to turn on the light source. The temperature control circuit is configured to increase the criterion time as the desired value decreases.

According to the lighting device of the twelfth aspect in accordance with the present invention, in addition to the tenth aspect, the power supply circuit is configured to regulate a magnitude of the operation power to a desired value to turn on the light source. The temperature control circuit is configured to decrease a difference between the first threshold and the second threshold as the desired value decreases.

According to the lighting device of the thirteenth aspect in accordance with the present invention, in addition to any one of the first to twelfth aspects, the light source includes a substrate on which the solid state light emitting device is mounted. The temperature detection circuit is mounted on the substrate.

According to the lighting device of the fourteenth aspect in accordance with the present invention, in addition to any one of the first to thirteenth aspects, the temperature control circuit is configured to measure the surrounding temperature by use of a thermosensitive device having a characteristic value varying with a temperature thereof.

The lighting fixture of the fifteenth aspect in accordance with the present invention includes: a fixture body configured hold a light source; and a lighting device of any one of the first to fourteenth aspects, for operating the light source.

DESCRIPTION OF EMBODIMENTS

Figure 1:
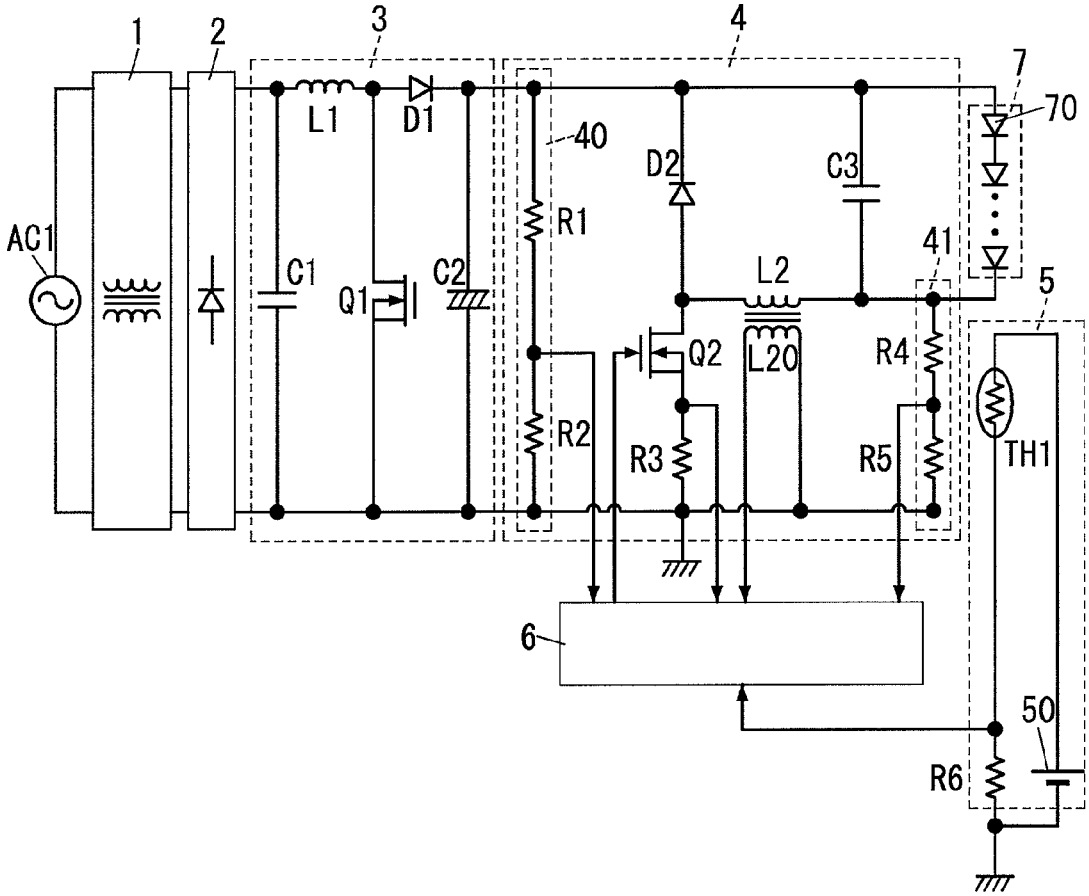
FIG. 1 is a schematic diagram illustrating circuitry of a lighting device of one embodiment in accordance with the present invention.

The lighting device of one embodiment in accordance with the present invention is used for operating a light source 7 including at least one solid state light emitting device (LED 70 in the present embodiment). As shown in FIG. 1, the lighting device of the present embodiment includes a noise filter 1, a rectifier 2, a PFC circuit 3, a power supply circuit 4, a temperature detection circuit 5, and a control circuit 6.

The noise filter 1 is an LC filter including a common mode choke coil and a capacitor, for example. The noise filter 1 is configured to remove noises from a power supply voltage outputted from a commercial power source AC1.

The rectifier 2 is constituted by a diode bridge circuit, for example. The rectifier 2 is configured to perform rectification on the power supply voltage outputted from the commercial power source AC1.

The PFC circuit 3 is a step-up chopper circuit, and includes an inductor L1, capacitors C1 and C2, a diode D1, and a switching device Q1. The switching device Q1 is a MOSFET. The PFC circuit 3 turns on and off the switching device Q1 at a high frequency by use of a driver (not shown), thereby increasing an output voltage of the rectifier 2 and outputting the resultant voltage. The PFC circuit 3 can improve a power factor with regard to an AC current outputted from the commercial power source AC1.

The power supply circuit 4 is a step-down chopper circuit, and includes an inductor L2, a capacitor C3, a diode D2, and a switching device Q2. The switching device Q2 is a MOSFET. The power supply circuit 4 is configured to supply, to the light source 7, DC power necessary for turning on the light source 7. In brief, the power supply circuit 4 supplies operation power (in the present embodiment, DC power) to the light source 7 to operate the light source 7.

The switching device Q2 is configured to be turned on and off according to a control signal from the control circuit 6. The switching device Q2 is connected in series with a resistor R3. A load current flowing through the light source 7 flows through the resistor R3 via the switching device Q2. Hence, a voltage across the resistor R3 is proportional to a magnitude of the load current, and is outputted to the control circuit 6 as a first detection signal. The inductor L2 includes a secondary winding L20. A voltage induced in the secondary winding L20 is outputted to the control circuit 6 as a second detection signal.

The power supply circuit 4 includes a first voltage dividing circuit 40 and a second voltage dividing circuit 41. The first voltage dividing circuit 40 is a series circuit of resistors R1 and R2, and is configured to divide the output voltage outputted from the PFC circuit 3 by use of the resistors R1 and R2. The second voltage dividing circuit 41 is a series circuit of resistors R4 and R5. The second voltage dividing circuit 41 is configured to divide a voltage applied across the inductor L2 by use of the resistors R4 and R5 while the switching device Q2 is turned on. The voltage dividing circuits 40 and 41 have the same division proportion. A voltage produced by the first voltage dividing circuit 40 is outputted to the control circuit 6 as a third detection signal. A voltage produced by the second voltage dividing circuit 41 is outputted to the control circuit 6 as a fourth detection signal.

The temperature detection circuit 5 measures a surrounding temperature of the light source 7 (i.e., a surrounding temperature of the LED 70). For example, the temperature detection circuit 5 is made by connecting a series circuit of a thermistor TH1 and a resistor R6 to a DC power source 50. Note that, the DC power source 50 is an external power source. Alternatively, the PFC circuit 3 may be used as the DC power source 50.

The thermistor TH1 is an NTC thermistor whose resistance decreases with an increase in a temperature thereof. The thermistor TH1 is not limited to the NTC thermistor. For example, a PTC thermistor whose resistance increases with an increase in temperature thereof may be used as the thermistor TH1.

The temperature detection circuit 5 is configured to divide the power supply voltage of the DC power source 50 by use of the thermistor TH1 and the resistor R6, and also to output the divided voltage to the control circuit 6 as a temperature signal. In other words, the temperature detection circuit 5 is configured to measure the surrounding temperature of the LED 70 of the light source 7 by use of a thermosensitive device with a characteristic value varying with a change in a temperature thereof.

In brief, the temperature detection circuit 5 measures the surrounding temperature of the light source 7, and outputs the measured surrounding temperature as the detection temperature. In the following description, the surrounding temperature of the LED 70 measured by the temperature detection circuit 5 is referred to as "detection temperature". A signal voltage of a temperature signal outputted from the temperature detection circuit 5 increases and decreases with an increase and decrease in the detection temperature.

Figure 4:
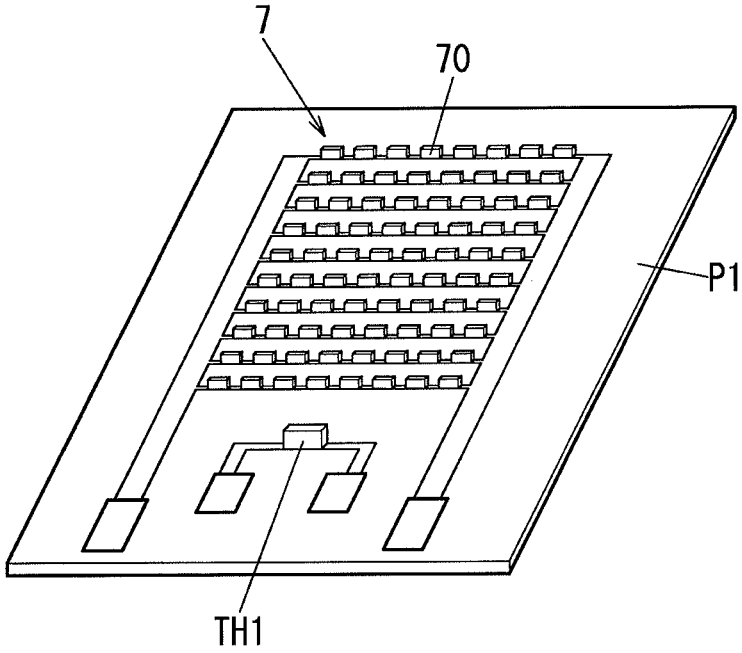
FIG. 4 is a schematic perspective view illustrating a substrate on which LEDs are mounted with regard to the above lighting device.

It is preferable that the thermistor TH1 be placed on the substrate P1 on which the LED 70 is mounted and be in a vicinity of the LED 70 as shown in FIG. 4. In other words, the light source 7 includes the substrate P1 on which the solid state light emitting device (LED 70) is mounted, and the temperature detection circuit 5 is mounted on the substrate P1. Thus, the temperature detection circuit 5 is placed on the substrate P1 on which the LED 70 is mounted as described above, thereby reducing a difference between an actual temperature of the LED 70 and the detection temperature. Note that, it is not always necessary that all of circuit components of the temperature detection circuit 5 are mounted on the substrate P1. In brief, it is sufficient that components of the temperature detection circuit 5 which are necessary for measuring the surrounding temperature are mounted on the substrate P1.

The control circuit 6 is constituted by a microcomputer, for example. The control circuit 6 is configured to control the output (i.e., the operation power) from the power supply circuit 4.

The control circuit 6 is configured to determine the load current based on the signal voltage of the first detection signal, and to detect zero-crossing of the load current based on the signal voltage of the second detection signal. Further, the control circuit 6 preliminarily stores an intended value of the load current (hereinafter referred to as "intended value of current"), and is configured to change the intended value of current based on the signal voltage of the temperature signal.

Figure 5:
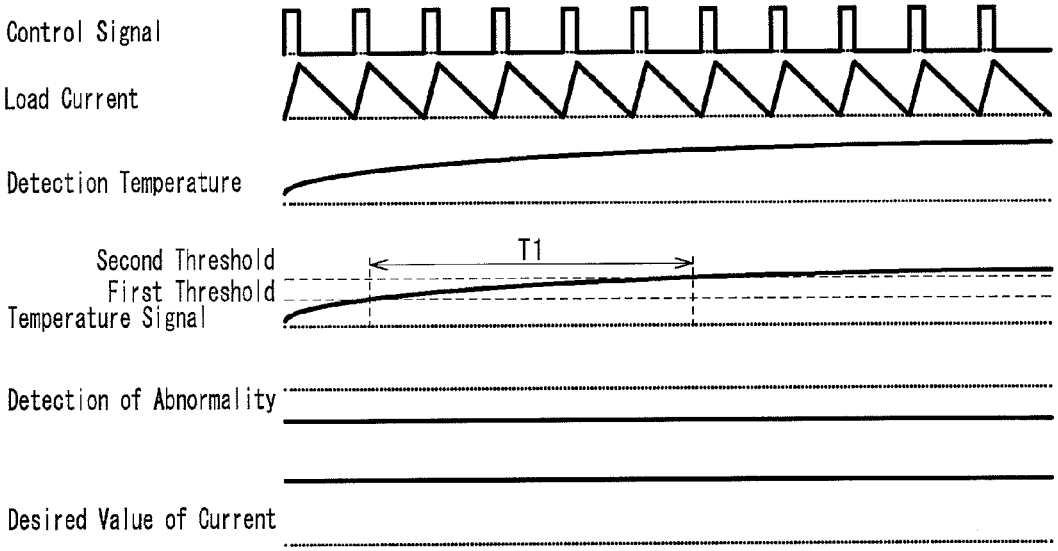
FIG. 5 is a time chart illustrating operations in the temperature control by the above lighting device while abnormality of the detection temperature is not detected.

The control circuit 6 is configured to turn on and off the switching device Q2 by providing the control signal thereto. When the signal voltage of the first detection signal reaches the intended value of current, the switching device Q2 is turned off. When the signal voltage of the second detection signal indicates the zero-crossing, the switching device Q2 is turned on. In brief, the control circuit 6 is configured to control the load current in a critical mode as shown in FIG. 5.

Further, the control circuit 6 is configured to determine a forward voltage of the LED 70 based on a difference between a signal voltage of the third detection signal from the first voltage dividing circuit 40 and a signal voltage of the fourth detection signal from the second voltage dividing circuit 41. When the above difference is small, the control circuit 6 determines that the light source 7 is disconnected. When the above difference is zero, the control circuit 6 determines that the light source 7 is electrically shorted. The control circuit 6 is configured to, when determining that the light source 7 is disconnected or electrically shorted, turn off the switching device Q2 to terminate the operation of the power supply circuit 4.

Note that, the control circuit 6 is not limited to a circuit constituted by a microcomputer only. For example, the control circuit 6 may be a circuit constituted by a combination of a microcomputer and an IC for power control such as FA5601 available from Fuji Electric and L6562A available from ST Microelectronics. Further, the control circuit 6 may be constituted by a combination of the IC for power control and an analog circuit.

The light source 7 is constituted by connecting the LEDs 70 in a series-parallel manner. The LEDs 70 are solid state light emitting devices. Each LED 70 emits light when a load current flows therethrough in response to the output from the power supply circuit 4. Note that, the light source 7 is not limited to a series circuit of the LEDs 70 but may be a parallel circuit of the LEDs 70 or a series-parallel circuit of the LEDs 70.

Hereinafter, a temperature control by the lighting device of the present embodiment is described. Firstly, a temperature control by a prior lighting device is described.

According to the prior lighting device, a device for temperature measurement such as a thermistor is placed in a vicinity of a light source, and the temperature control is performed when a detection temperature exceeds a predetermined threshold. For example, as shown in FIGS. 7 (*a*) and (*b*), when the detection temperature exceeds the threshold, the light source is dimmed such that a percentage of a light output of the light source is decreased from 100% down to 80% in order to decrease a temperature of the light source.

Figure 7:
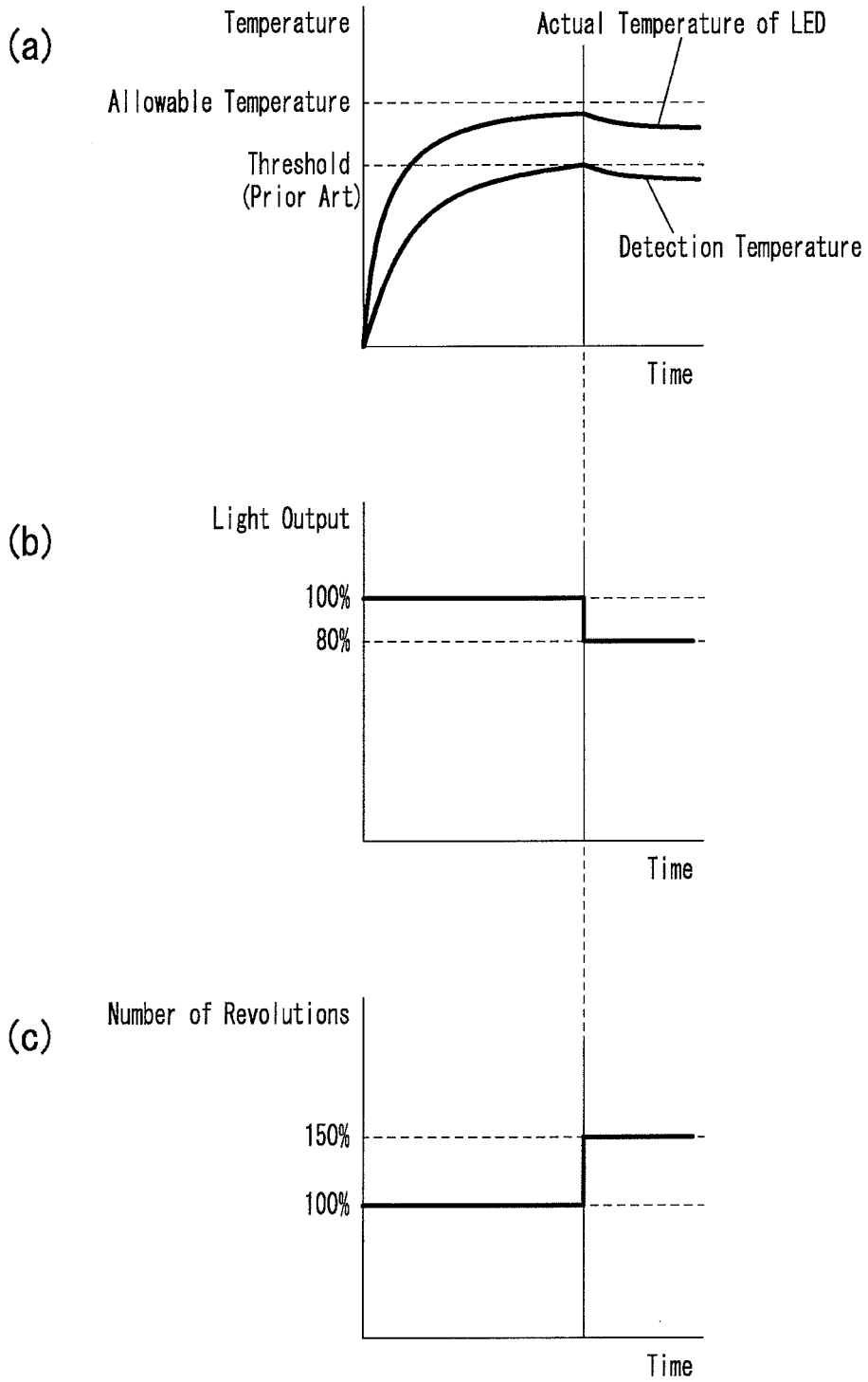
FIGS. 7 (*a*) to (*c*) are diagrams illustrating a temperature control by a prior lighting device.

Alternatively, in the case where a fan for cooling the light source is provided, a percentage of the number of revolutions of the fan to a normal number of revolutions is increased from 100% up to 150% as shown in FIG. 7 (*c*) in order to decrease the temperature of the light source.

As described above, the detection temperature is compared with the predetermined threshold and the temperature control is performed such that the temperature of the LED constituting the light source does not exceed an allowable temperature of the LED.

A correlation between an actual temperature of the LED and the detection temperature is affected by some causes such as a power loss in the LED, a positional relation between the LED and a device for temperature measurement, and installation conditions of the LED and the device for temperature measurement. Further, when the LED is thermally connected to a heat sink, the above correlation is also affected by a size of the heat sink and a connection condition between the LED and the heat sink. Additionally, when a fan is used for cooling the light source, a performance of the fan also affects the above correlation.

For example, if the LED and the heat sink are connected incompletely due to poor workmanship, the above correlation may be lost due to the deterioration in the heat dissipation performance of the heat sink. Additionally, if the LED and the heat sink are connected incompletely due to aging deterioration, the above correlation may be lost due to the deterioration in the heat dissipation performance of the heat sink. When the fan is used for cooling the light source, the heat dissipation performance of the fan becomes poor due to a deterioration of the fan and thereby the above correlation may be lost. Besides, if the power supply circuit which supplies power to the light source operates abnormally to overload the LED, the LED may be excessively heated and thus the above correlation may be lost.

When the correlation is lost due to such abnormalities, a heat capacity of the LED becomes small and hence the temperature of the LED tends to rapidly increase. Accordingly, a difference between the actual temperature of the LED and the detection temperature becomes greater. Particularly, when a temperature measurement element is installed on the heat sink, the incomplete connection between the heat sink and the LED inhibits heat transfer into the temperature measurement element. Hence, the difference in temperature becomes prominent.

Figure 8:
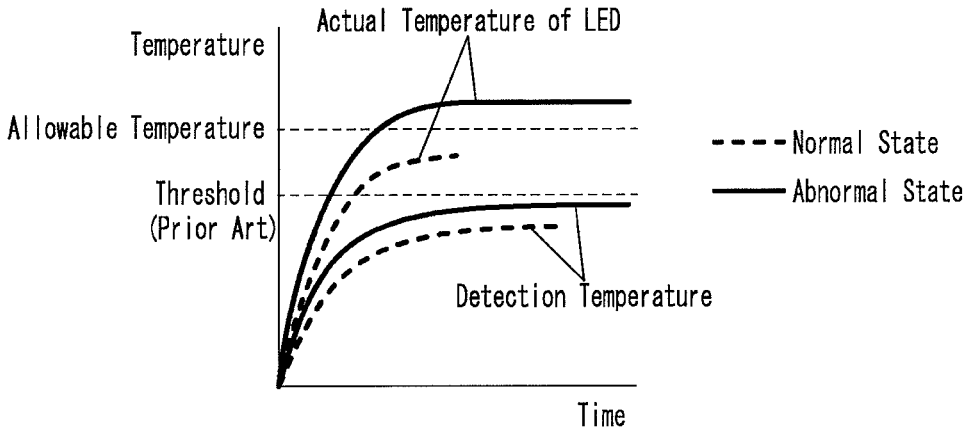
FIG. 8 is a diagram for illustrating a problem in the prior lighting device.
Figure 9:
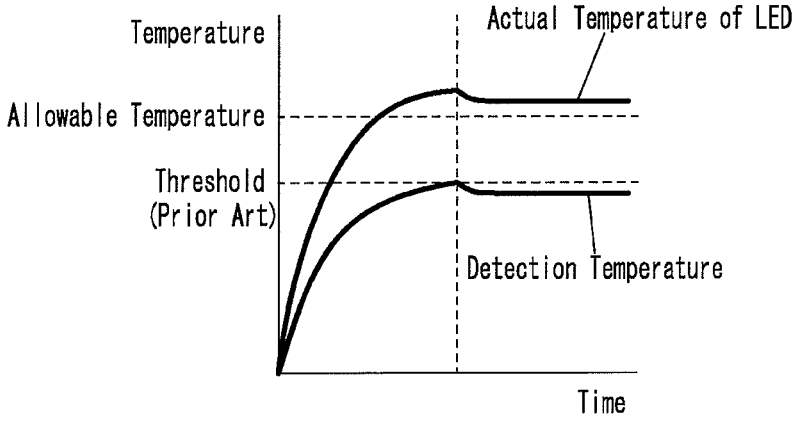
FIG. 9 is a diagram for illustrating a problem in the prior lighting device.

For example, in a case shown in FIG. 8, the detection temperature does not exceed the threshold and accordingly the temperature control is not performed. Nevertheless, the actual temperature of the LED exceeds the allowable temperature. Further, in a case shown in FIG. 9, the detection temperature exceeds the threshold and accordingly the temperature control is performed. Nevertheless, the actual temperature of the LED exceeds the allowable temperature.

As described above, in the prior lighting device, when the connection between the heat sink and the LED is incomplete or when the overload occurs, the actual temperature of the LED exceeds the allowable temperature. This is likely to decrease a light emission efficiency and shorten a lifetime of the LED, for example In view of the above, to solve the above problem, the lighting device of the present embodiment performs the temperature control as follows.

First, when power supply to the lighting device of the present embodiment starts, each circuit operates to turn on the LED 70 and therefore the temperature of the LED 70 starts to increase. In this case, as shown in FIG. 5, the signal voltage of the temperature signal also increases with an increase in the temperature of the LED 70.

The control circuit 6 measures required time T1 necessary for the signal voltage of the temperature signal to reach a second threshold after the signal voltage of the temperature signal reaches a first threshold. The second threshold is greater than the first threshold. When the required time T1 is not less than predetermined criterion time T0, that is, an increase rate of the detection temperature is less than a criterion value, the control circuit 6 determines that the detection temperature does not operate abnormally. In this case, the control circuit 6 does not change the intended value of the load current.

Figure 6:
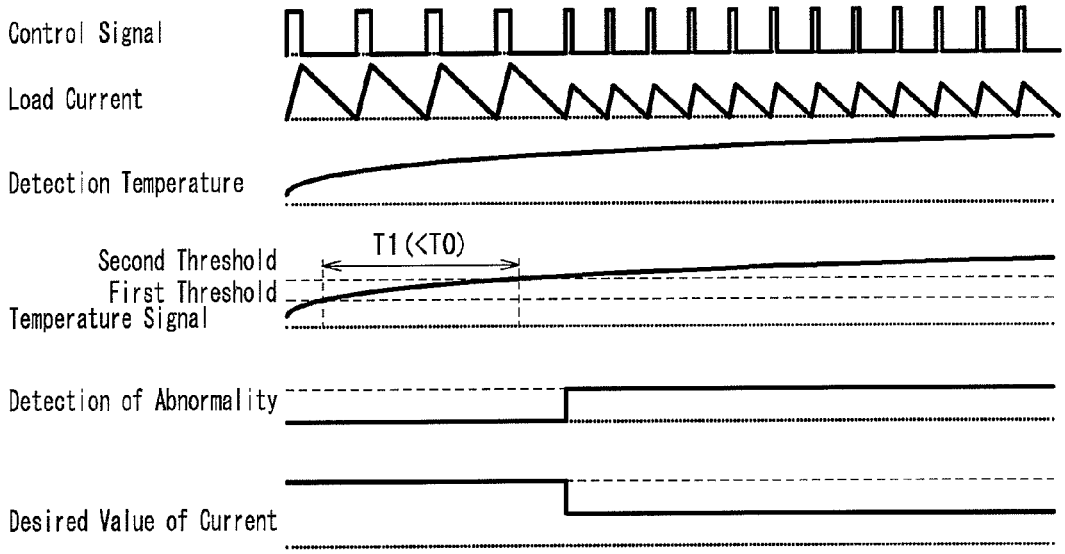
FIG. 6 is a time chart illustrating operations in the temperature control by the above lighting device when the abnormality of the detection temperature is detected.

As shown in FIG. 6, when the required time T1 is less than the criterion time T0, that is, the increase rate of the detection temperature is greater than the criterion value, the control circuit 6 determines that the detection temperature operates abnormally, and decreases the intended value of the load current.

Accordingly, a duty cycle of the switching device Q2 is decreased and therefore the load current flowing through the LED 70 is reduced. Consequently, the light output of the LED 70 decreases. The temperature of the LED 70 is decreased with a decrease in the light output of the LED 70.

As described above, the lighting device of the present embodiment includes a temperature control circuit (temperature controlling means) for controlling the temperature of the light source 7. The temperature control circuit determines whether the increase rate of the surrounding temperature exceeds the predetermined criterion value. When determining that the increase rate exceeds the criterion value, the temperature control circuit performs a process (temperature decreasing process) of decreasing the temperature of the light source 7. Meanwhile, when determining that the increase rate does not exceed the criterion value, the temperature control circuit does not perform the process (temperature decreasing process).

In the present embodiment, the temperature control circuit calculates the required time T1 necessary for the detection temperature to reach the second threshold from the first threshold, when supply of the operation power from the power supply circuit 4 to the light source 7 is started. When the required time T1 is not greater than the predetermined criterion time T0, the temperature control circuit determines that the increase rate exceeds the criterion value.

In the configuration shown in FIG. 1, the temperature control circuit is the control circuit 6 for controlling the power supply circuit 4. The temperature control circuit is configured to, in the above process (temperature decreasing process), decrease the operation power (i.e., the power supplied from the power supply circuit 4 to the light source 7).

As described above, in the lighting device of the present embodiment, the control circuit 6 serving as the temperature controlling means (temperature control circuit) performs the temperature control on the LED 70 based on not the detection temperature itself but the increase rate of the detection temperature.

Figure 3:
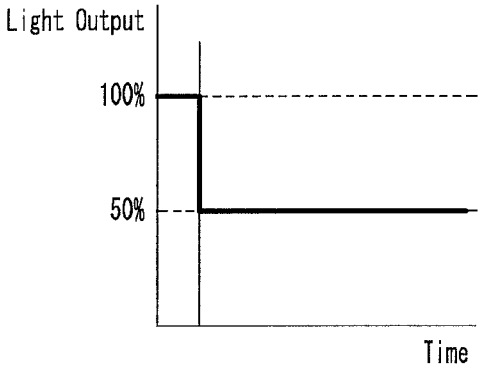
FIG. 3 is a diagram illustrating a variation of a light output of a light source in a temperature control by the above lighting device.

Hence, in the lighting device of the present embodiment, the control circuit 6 can detect the abnormality of the detection temperature in an initial period in which the temperature of the LED 70 rises, as shown in FIG. 3. Also the control circuit 6 can decrease the percentage of the light output from 100% down to 50%, thereby decreasing the temperature of the LED 70.

Figure 2:
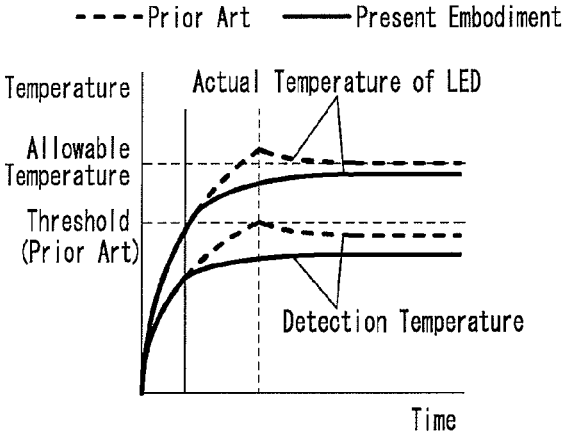
FIG. 2 is a diagram illustrating a correlation between an actual temperature of an LED and a detection temperature with regard to the above lighting device.

Consequently, as shown in FIG. 2, an increase in the temperature of the LED 70 can be suppressed to avoid that the temperature of the LED 70 exceeds the allowable temperature. Thus, the temperature of the LED 70 can be adjusted appropriately. Therefore, the lighting device of the present embodiment can prevent deterioration of the light emission efficiency and the lifetime of the LED 70, for example. Note that, the degree of decreasing the light output of the light source 7 by the temperature control can be determined based on intended applications.

Figure 10:
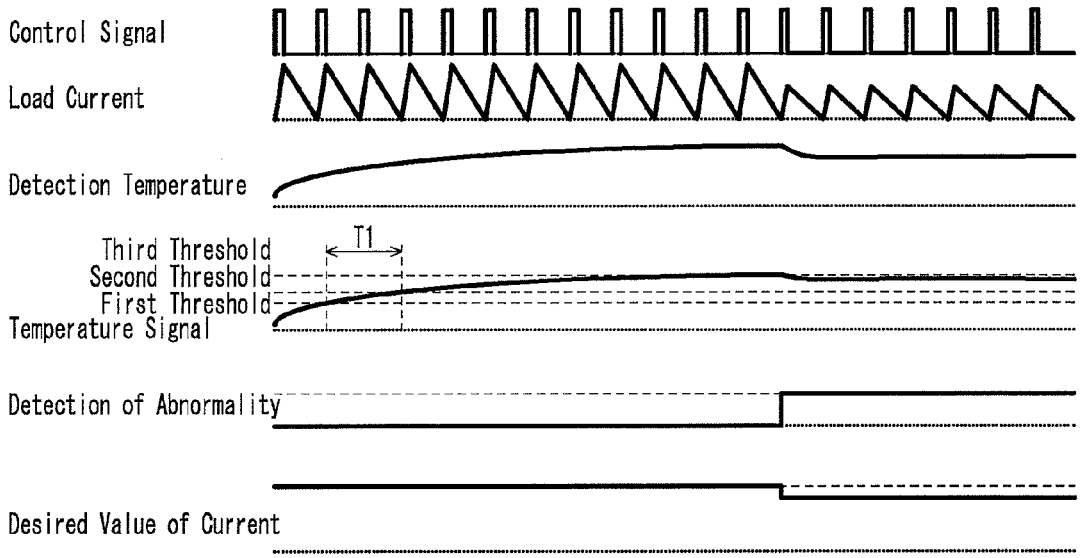
FIG. 10 is a time chart illustrating operations in the other temperature control by the above lighting device when the abnormality of the detection temperature is detected.
Figure 11:
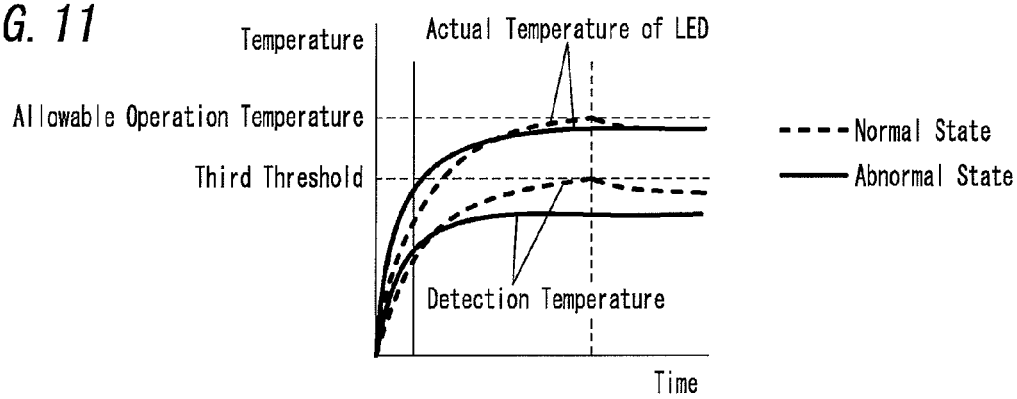
FIG. 11 is a diagram illustrating the correlation between the actual temperature of the LED and the detection temperature with regard to the other temperature control by the above lighting device.
Figure 12:
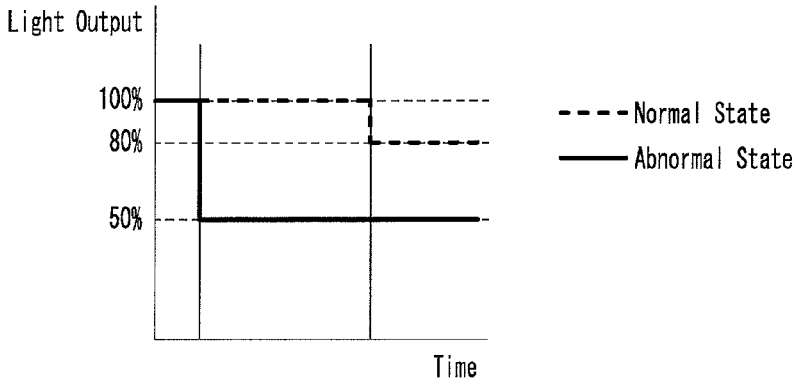
FIG. 12 is a diagram illustrating the variation of the light output of the light source in the other temperature control by the above lighting device.

Besides, as shown in FIGS. 10 to 12, the control circuit 6 may be configured to, when the signal voltage of the temperature signal reaches a third threshold (greater than the second threshold), decrease the percentage of the light output of the light source 7 from 100% down to 80%.

According to this configuration, even when the increase rate of the detection temperature does not exceed the criterion value (i.e., the abnormality of the detection temperature does not occur), the temperature of the LED 70 can be adjusted appropriately. Note that, the degree of decreasing the light output of the light source 7 by the temperature control can be determined based on intended applications.

Figure 13:
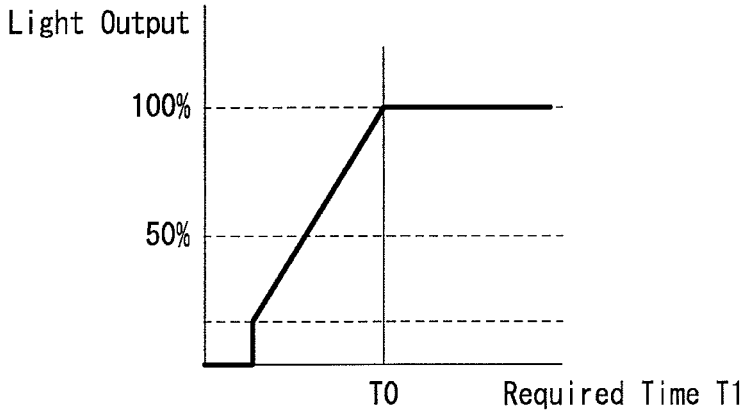
FIG. 13 is a diagram illustrating a correlation between the light output and required time in the temperature control by the above lighting device.

Further, as shown in FIG. 13, the control circuit 6 may be configured to gradually reduce the light output of the light source 7 with a decrease in the required time T1 (i.e., the control circuit 6 may be configured to change the output from the power supply circuit 4 with an increase or a decrease in the increase rate of the detection temperature).

In brief, the temperature control circuit (control circuit 6), in the process (temperature decreasing process), may determine the operation power according to the magnitude of the increase rate. Particularly, it is preferable that the temperature control circuit (control circuit 6) decrease the operation power as the increase rate increases.

This configuration can increase the light output of the light source 7 as possible while keeping the temperature of the LED 70 not greater than the allowable temperature. Therefore, it is enabled to avoid that the light output of the light source 7 is decreased more than necessary.

Figure 14:
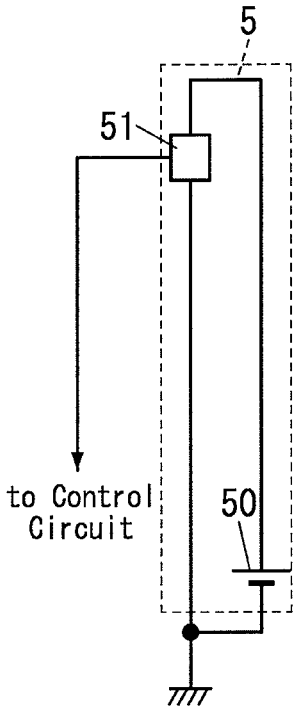
FIG. 14 is a partial schematic diagram illustrating circuitry of the above lighting device including a temperature sensor IC.

Alternatively, as shown in FIG. 14, in the temperature detection circuit 5, a set of the thermistor TH1 and the resistor R6 may be replaced with a temperature sensor IC 51 as a thermosensitive device. For example, LM50 available from National Semiconductor is used as the temperature sensor IC 51.

Figure 15:
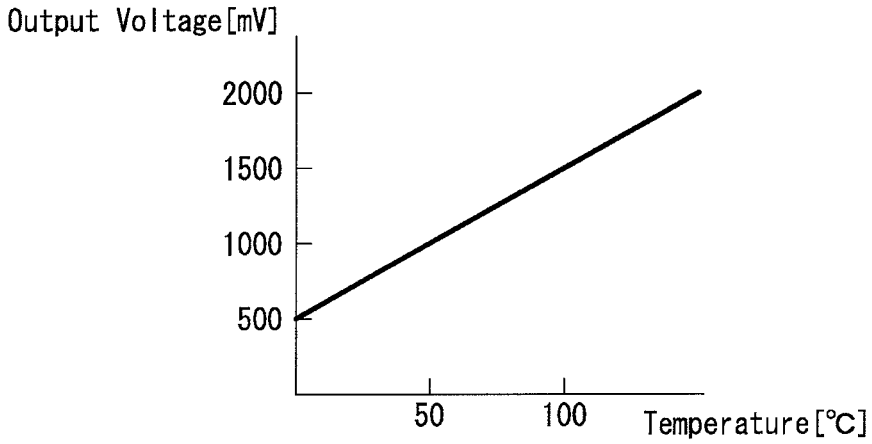
FIG. 15 is a diagram illustrating a correlation between an output voltage and the detection temperature of the above temperature sensor IC

As shown in FIG. 15, this temperature sensor IC 51 has such a characteristic that a signal voltage of the temperature signal outputted therefrom is proportional to a detection temperature. Therefore, the temperature signal outputted from the temperature sensor IC 51 increases or decreases with an increase or a decrease in the detection temperature in a similar manner to a case in which the set of the thermistor TH1 and the resistor R6 is used.

In this case, the control circuit 6 changes the intended value of current based on the signal voltage outputted from the temperature sensor IC 51. This configuration can also provide the same advantageous effect as the configuration shown in FIG. 1.

Besides, a decrease in the temperature of the LED 70 may be achieved by using a cooling device 8 instead of reducing the light output of the light source 7.

Figure 16:
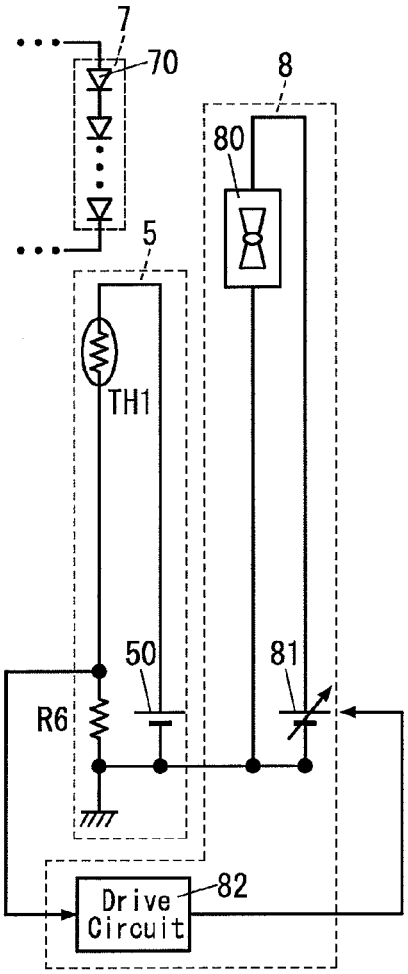
FIG. 16 is a partial schematic diagram illustrating circuitry of the above lighting device including a fan.

The following explanation referring to the drawings is made to the configuration employing the cooling device 8. This configuration includes the cooling device 8 having a fan 80, a drive power source 81, and a drive circuit 82, as shown in FIG. 16.

The fan 80 is placed in a vicinity of the light source 7. The fan 80 supplies air to the light source 7 to cool the light source 7. In brief, the fan 80 is a cooler for cooling the light source 7.

The drive power source 81 is constituted by a microcomputer, for example. The drive power source 81 is configured to output a drive voltage for operating the fan 80.

When the output voltage (drive voltage) of the drive power source 81 is varied, the number of revolutions of the fan 80 is varied and consequently wind power (output) from the fan 80 is varied. In brief, the fan 80 is a cooler whose cooling capacity increases with an increase in a magnitude of the drive power (in the present embodiment, the drive voltage).

The drive circuit 82 is configured to vary the number of revolutions of the fan 80 by changing the output voltage from the drive power source 81. In brief, the drive circuit 82 supplies the drive power (in the present embodiment, the drive voltage) to the cooler (fan 80).

Hereinafter, the temperature control of the LED 70 by this configuration is described briefly.

The drive circuit 82 measures the required time T1 necessary for the signal voltage of the temperature signal from the temperature detection circuit 5 to reach the second threshold after the signal voltage of the temperature signal reaches the first threshold. When the required time T1 is not less than the criterion time T0, that is, the increase rate of the detection temperature is less than the criterion value, the drive circuit 82 determines that there is no abnormality in the detection temperature. In this case, the drive circuit 82 does not change the output voltage from the drive power source 81.

Figure 17:
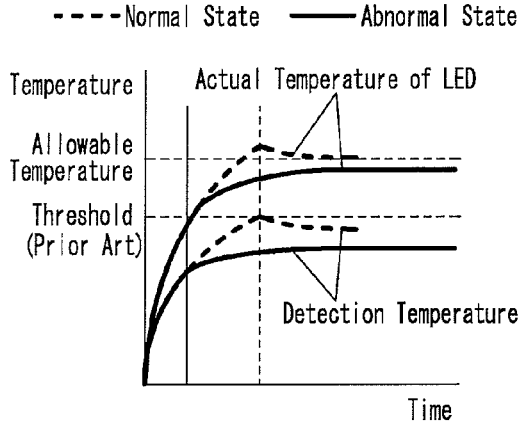
FIG. 17 is a diagram illustrating the correlation between the actual temperature of the LED and the detection temperature with regard to the above lighting device including the fan.

When the required time T1 is less than the criterion time T0, that is, the increase rate of the detection temperature is greater than the criterion value, the drive circuit 82 determines that the abnormality of the detection temperature occurs, and increases the output voltage from the drive power source 81. Accordingly, the number of revolutions of the fan 80 is increased and therefore the force of the air is also increased. Thus, a cooling effect of the fan 80 increases, and therefore the temperature of the LED 70 is decreased. Consequently, as shown in FIG. 17, an increase in the temperature of the LED 70 can be suppressed to avoid that the temperature of the LED 70 exceeds the allowable temperature. Thus, the temperature of the LED 70 can be adjusted appropriately.

Figure 18:
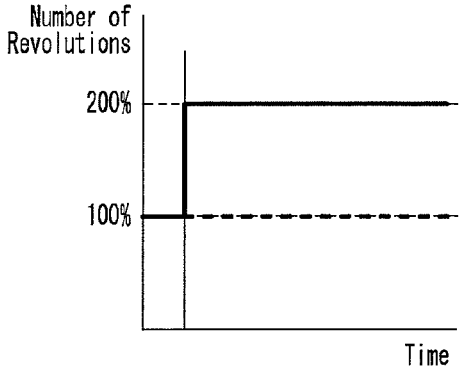
FIG. 18 is a diagram illustrating a variation of the number of revolutions of the fan in the temperature control by the above lighting device including the fan.

In this regard, as shown in FIG. 18, the drive circuit 82 changes a percentage of the number of revolutions of the fan 80 from 100% to 200% when detecting occurrence of the abnormality of the detection temperature at the initial stage of an increase in the temperature of the LED 70. Therefore, this configuration also can provide the same advantageous effect as the configuration shown in FIG. 1.

In summary, in the configuration shown in FIG. 16, the temperature control circuit is the drive circuit 82 for adjusting the drive power supplied to the cooler (fan 80). The temperature control circuit is configured to, in the process (temperature decreasing process), decrease the drive power (i.e., the power supplied from the drive power source 81 to the fan 80).

Figure 19:
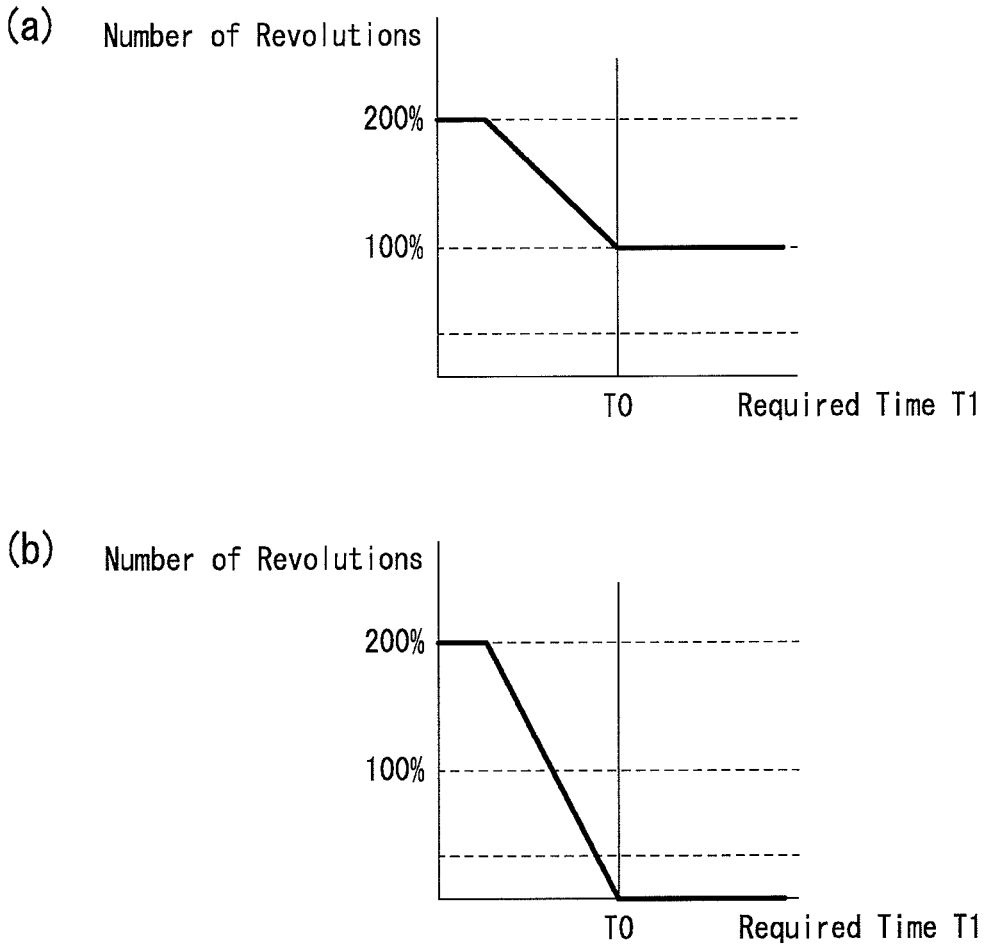
FIGS. 19 (*a*) and (*b*) each are a diagram illustrating a correlation between the number of revolutions of the fan and the required time in the temperature control by the above lighting device.

Further, as shown in FIGS. 19 (*a*) and (*b*), the drive circuit 82 may be configured to increase the number of revolutions of the fan 80 as the required time T1 becomes shorter than the criterion time T0 (i.e., the drive circuit 82 may be configured to change the output from the cooler with an increase or a decrease in the increase rate of the detection temperature).

In brief, the temperature control circuit (drive circuit 82) may determine the drive power according to the magnitude of the increase rate in the process (temperature decreasing process). Particularly, it is preferable that the temperature control circuit (drive circuit 82) increase the drive power as the increase rate increases.

According to this configuration, an optimal temperature control can be performed depending on the abnormality of the LED 70. For example, the cooling effect is enhanced as the increase rate of the detection temperature increases. Note that, while the temperature decreasing process is not performed, the fan 80 is not necessarily required to operate. In brief, the fan 80 may be activated only in the temperature decreasing process.

The lighting device of the present embodiment may be configured to dim the light source 7 based on a dimming signal received from a dimmer (not shown).

In brief, the power supply circuit 4 may regulate a magnitude of the operation power to a desired value to turn on the light source 7. The desired value is determined based on the dimming signal, for example. For example, the control circuit 6 can dim the light source 7 by changing the intended value of current (i.e., the output voltage from the power supply circuit 4) based on the dimming signal.

Figure 20:
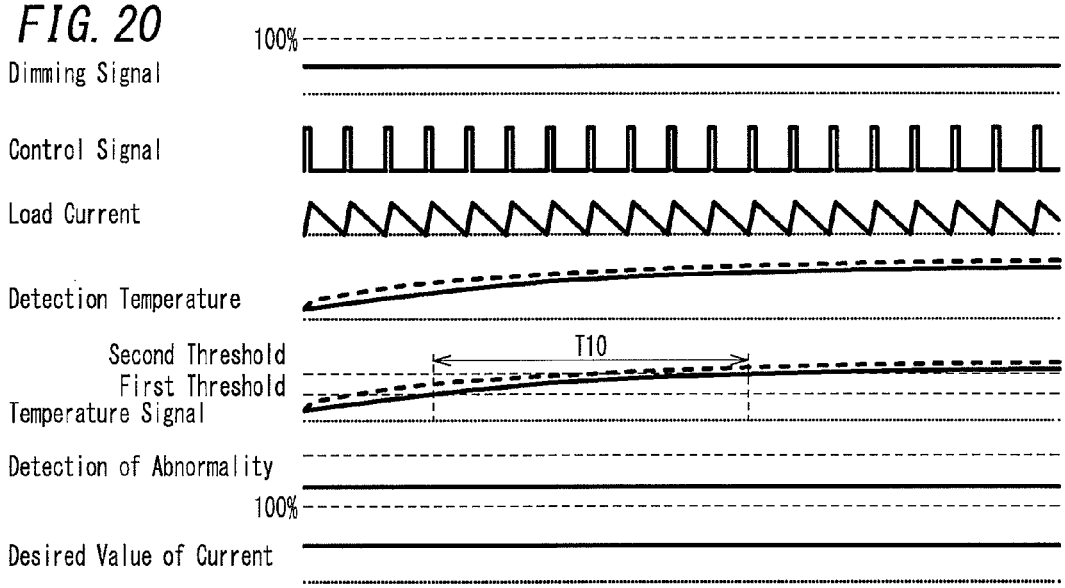
FIG. 20 is a time chart illustrating operations in the temperature control by the above lighting device performing a dimming control while the abnormality of the detection temperature is not detected.

As shown in FIG. 20, in a case that the light source 7 is dimmed (illustrated by solid lines in FIG. 20), the detection temperature increases gradually as compared with a case that the light source 7 is operated at full power (illustrated by broken lines in FIG. 20). This is because an amount of heat generated in the LED 70 decreases with a decrease in the light output of the light source 7. Therefore, required time T10 is longer than the required time T1. The required time T10 means the required time in the case that the light source 7 is dimmed. The required time T1 means the required time in the case that the light source 7 is operated at full power. The required time is time necessary for the signal voltage of the temperature signal to reach the second threshold after reaching the first threshold.

As a result, even when the abnormality of the LED 70 occurs to make the increase rate of the temperature greater, the required time T10 is longer than the required time T1 in some cases. Hence, the required time T10 is likely to not fall below the criterion time T0. In this case, the temperature control on the LED 70 by the control circuit 6 is not performed and therefore the temperature of the LED 70 exceeds the allowable temperature. Consequently, undesirable effects such as decreases in the light emission efficiency and in the lifetime of the LED 70 are likely to occur.

According to this reason, when the light source 7 is dimmed, it is preferable that the control circuit 6 increase or decrease the criterion time T0 depending on the output voltage (desired value) of the power supply circuit 4. In brief, the temperature control circuit (control circuit 6) may determine the criterion value according to the desired value. Particularly, it is preferable that the temperature control circuit decrease the criterion value as the desired value decreases.

Figure 22:
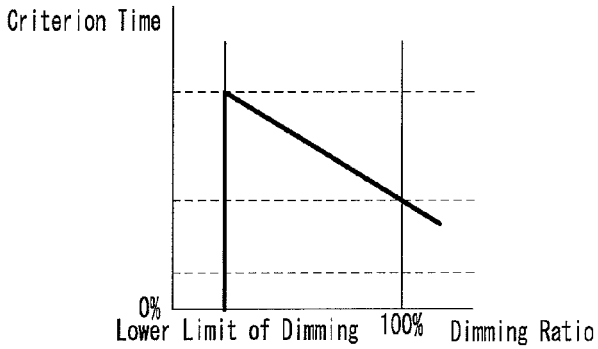
FIG. 22 is a diagram illustrating a correlation between a dimming ratio and criterion time with regard to the temperature control by the above lighting device performing the dimming control.

For example, as shown in FIG. 22, the control circuit 6 is configured to increase or decrease the criterion time T0 (i.e., the criterion value) according to an increase or a decrease in the dimming ratio (i.e., an increase or a decrease in the output from the power supply circuit 4). In brief, the temperature control circuit (control circuit 6) determines the criterion time T0 according to the desired value. Particularly, it is preferable that the temperature control circuit increase the criterion time T0 as the desired value decreases.

Figure 21:
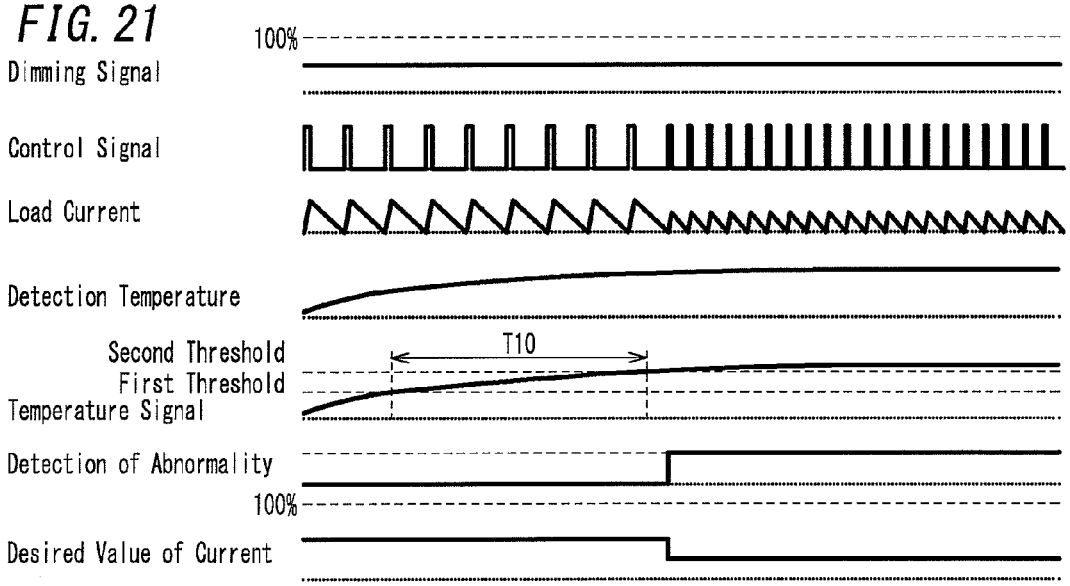
FIG. 21 is a time chart illustrating operations in the temperature control by the above lighting device performing the dimming control when the abnormality of the detection temperature is detected.

According to this configuration, as shown in FIG. 21, when the required time T10 falls below the criterion time T0 determined according to the dimming ratio, the control circuit 6 determines that the abnormality of the detection temperature occurs. And then, the circuit 6 reduces the intended value of the load current to decrease the light output of the light source 7. Therefore, this configuration makes it possible to perform temperature control on the LED 70 even when the light source 7 is dimmed.

Figure 25:
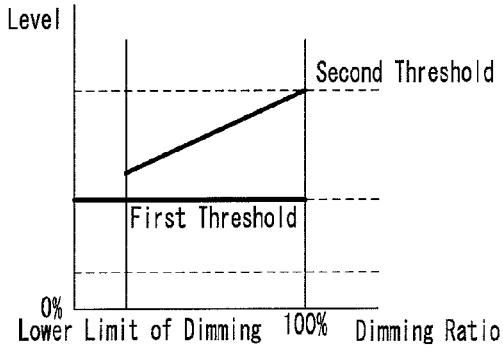
FIG. 25 is a diagram illustrating a correlation between the dimming ratio and each threshold with regard to the other temperature control by the above lighting device performing the dimming control.

Note that, as shown in FIG. 25, when the first threshold is set to be constant, the control circuit 6 may be configured to keep the first threshold constant and vary the second threshold with a variation in an increase or a decrease in the dimming ratio (an increase or a decrease in the output from the power supply circuit 4). In brief, the temperature control circuit (control circuit 6) may determine the second threshold according to the desired value. Particularly, it is preferable that the temperature control circuit decrease the second threshold as the desired value decreases.

In this configuration, the second threshold is changed with a change in the increase rate of the detection temperature. As a result, the required time T1 is not changed with a change in the dimming ratio.

Figure 23:
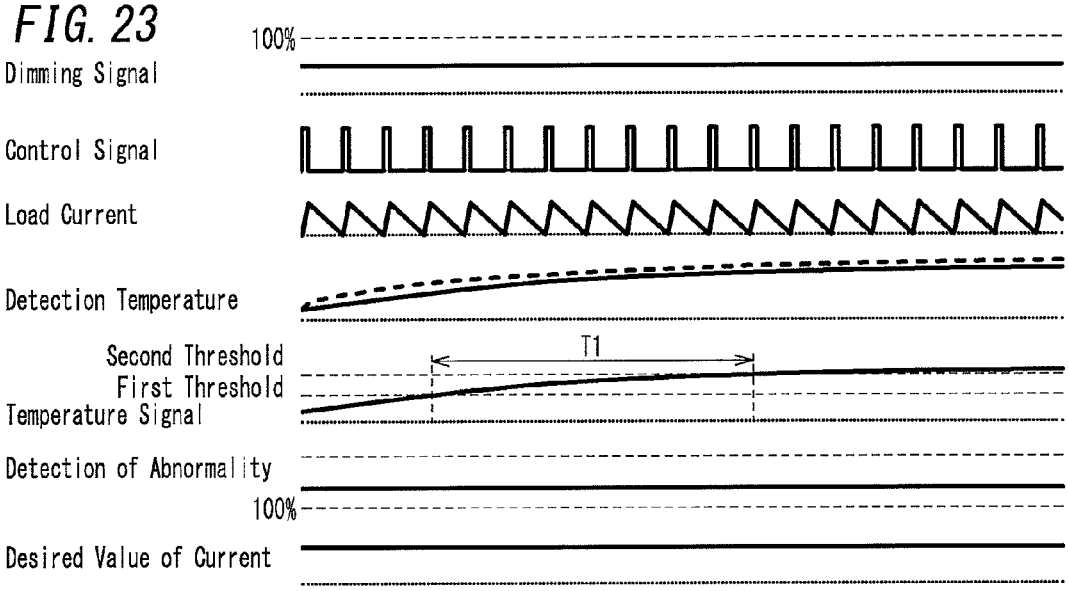
FIG. 23 is a time chart illustrating operations in the other temperature control by the above lighting device performing the dimming control while the abnormality of the detection temperature is not detected.
Figure 24:
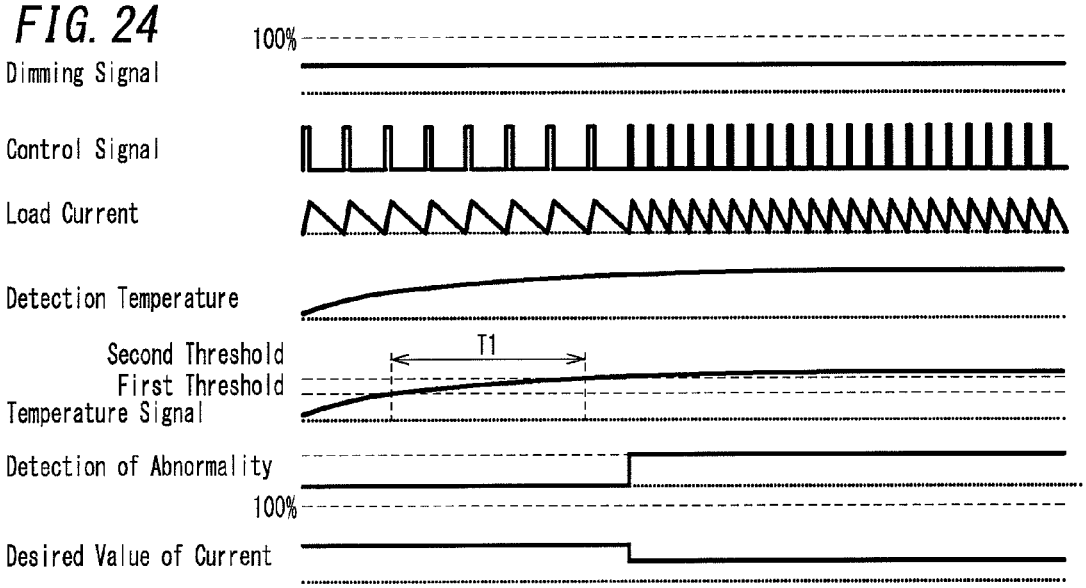
FIG. 24 is a time chart illustrating operations in the other temperature control by the above lighting device performing the dimming control when the abnormality of the detection temperature is detected.

Hence, as shown in FIGS. 23 and 24, when the required time T1 falls below the criterion time T0, the control circuit 6 determines that the abnormality of the detection temperature occurs. The control circuit 6 then reduces the intended value of the load current to decrease the light output of the light source 7.

Accordingly, this configuration also can perform the temperature control on the LED 70 in a case where the light source 7 is dimmed.

Alternatively, the control circuit 6 may be configured to keep the second threshold constant and vary the first threshold with a variation in the dimming ratio. In brief, the temperature control circuit (control circuit 6) may determine the first threshold according to the desired value. Particularly, it is preferable that the temperature control circuit increase the first threshold as the desired value decreases. This configuration can produce the same advantageous effect as the above.

In short, according to the desired value, the temperature control circuit (control circuit 6) determines a difference between the first threshold and the second threshold. Especially, it is preferable that the temperature control circuit decrease the difference between the first threshold and the second threshold as the desired value decreases. In other words, it is preferred that the temperature control circuit (control circuit 6) changes a formula for calculating the increase rate (formula for calculating the required time T1) to prevent the increase rate from changing with a change in the desired value.

Figure 26:
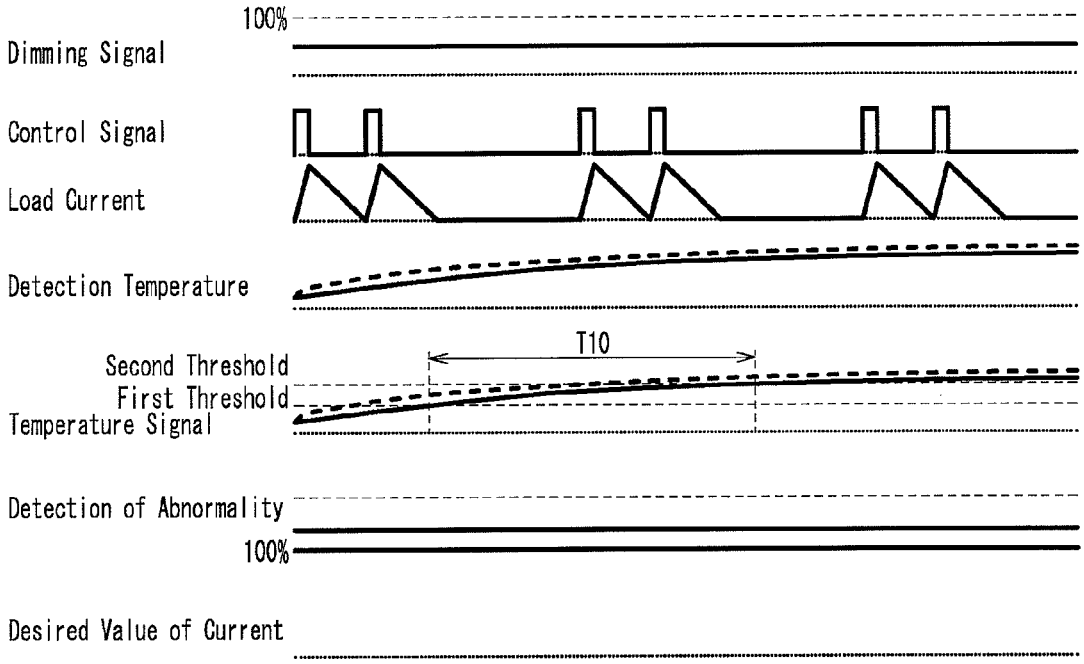
FIG. 26 is a time chart illustrating operations in the temperature control by the above lighting device performing the other dimming control while the abnormality of the detection temperature is not detected.

As shown in FIG. 26, the light source 7 can be dimmed by an intermittent control. In the intermittent control, an operation period and a rest period are repeated alternately. In the operation period the switching device Q2 is turned on and off alternately, and in the rest period the switching device Q2 is kept turned off. Also in this configuration, the temperature of the LED 70 increases gradually. Accordingly, in a similar manner as the above, the criterion time T0 or the second threshold may be varied with a variation in the dimming ratio (an increase or a decrease in the output from the power supply circuit 4).

Figure 27:
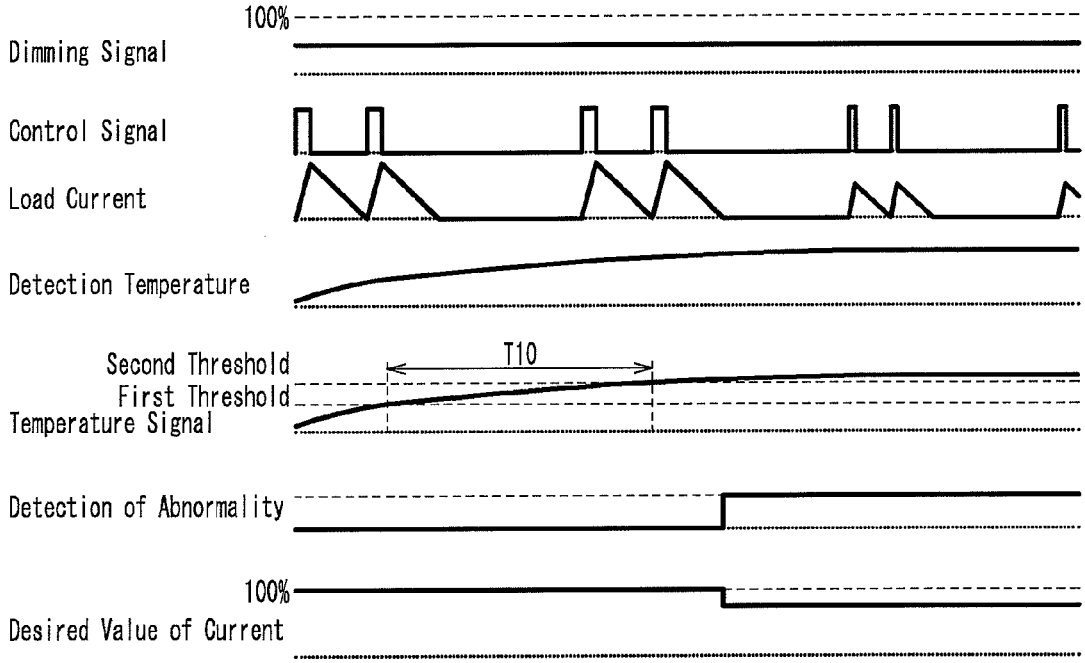
FIG. 27 is a time chart illustrating operations in the temperature control by the above lighting device performing the other dimming control when the abnormality of the detection temperature is detected.

For example, with regard to a case that the criterion time T0 is varied with a variation in the dimming ratio, the control circuit 6 decreases the light output of the light source 7 when the required time T1 falls below the criterion time T0, as shown in FIG. 27. Therefore, this configuration also makes it possible to perform the temperature control on the LED 70 in a case that the light source 7 is dimmed.

Besides, the above explanation is made to a case that the control circuit 6 serves as the temperature controlling means. However, the above technical concept can be applied to a case that the drive circuit 82 serves as the temperature controlling means. When the light source 7 is dimmed, the drive circuit 82 may vary the criterion time T0 or the second threshold with a variation in the dimming ratio.

Note that, in the lighting device of the present embodiment, the LED 70 is used as a solid state light emitting device used for the light source 7. Alternatively, the light source 7 may be constituted by another solid state light emitting device such as a semiconductor laser device and an organic EL device.

As described above, the lighting device of the present embodiment includes: the power supply circuit 4 configured to supply power to the light source 7 with the solid state light emitting device (LED 70); the temperature detection circuit 5 configured to measure the surrounding temperature of the solid state light emitting device; and the temperature controlling means configured to control the temperature of the solid state light emitting device. The temperature controlling means is configured to calculate the increase rate of the detection temperature measured by the temperature detection circuit 5, and decrease the temperature of the solid state light emitting device when the increase rate exceeds the predetermined criterion value.

In the lighting device of the present embodiment, it is preferable that the temperature detection circuit 5 be placed on the substrate P1 on which the solid state light emitting device is mounted.

In the lighting device of the present embodiment, it is preferable that the temperature controlling means be the control circuit 6 configured to control the output of the power supply circuit 4. Further it is preferable that the control circuit 6 be configured to decrease the temperature of the solid state light emitting device by reducing the output of the power supply circuit 4.

In the lighting device of the present embodiment, it is preferable that the control circuit 6 be configured to change the output of the power supply circuit 4 depending on an increase and a decrease in the increase rate of the detection temperature.

In the lighting device of the present embodiment, it is preferable that the lighting device include the cooling device 8 including the cooler (fan 80) configured to cool the light source 7 and the drive circuit 82 configured to change an output of the cooler (fan 80). Further it is preferable that the temperature controlling means be the drive circuit 82 and that the drive circuit 82 be configured to decrease the temperature of the solid state light emitting device by increasing the output of the cooler (fan 80).

In the lighting device of the present embodiment, it is preferable that the drive circuit 82 be configured to change the output of the cooling device 8 depending on an increase and a decrease in the increase rate of the detection temperature.

In the lighting device of the present embodiment, it is preferable that the temperature controlling means be configured to change the criterion value depending on an increase and a decrease in the output of the power supply circuit 4.

In the lighting device of the present embodiment, it is preferable that the temperature detection circuit 5 be configured to measure the temperature of the solid state light emitting device by use of the thermosensitive device with the characteristics value varying with a change in the temperature thereof.

In brief, the lighting device of the present embodiment includes the following first feature.

According to the first feature, the lighting device includes the power supply circuit 4, the temperature detection circuit 5, and the temperature control circuit (the control circuit 6 or the drive circuit 82). The power supply circuit 4 is configured to supply the operation power to the light source 7 including the solid state light emitting device (e.g., the LED 70). The temperature detection circuit 5 is configured to measure the surrounding temperature of the light source 7 and output the measured surrounding temperature as the detection temperature. The temperature control circuit is configured to determine whether the increase rate of the surrounding temperature exceeds the predetermined criterion value. The temperature control circuit is configured to, when determining that the increase rate exceeds the criterion value, perform the process (temperature decreasing process) of decreasing the temperature of the light source 7.

Further, the lighting device of the present embodiment includes the following second to fourth features. Besides, the second to fourth features are optional.

According to the second feature depending on the first feature, the temperature control circuit is the control circuit 6 configured to control the power supply circuit 4. The temperature control circuit is configured to, in the process (temperature decreasing process), decrease the operation power.

According to the third feature depending on the second feature, the temperature control circuit is configured to, in the process (temperature decreasing process), determine the operation power according to the magnitude of the increase rate.

According to the fourth feature depending on the third feature, the temperature control circuit is configured to, in the process (temperature decreasing process), decrease the operation power as the increase rate increases.

Besides, the lighting device of the present embodiment may include the following fifth to seventh features instead of the second to fourth features. Obviously, the fifth to seventh features are optional.

According to the fifth feature depending on the first feature, the lighting device further includes the cooler (e.g., the fan 80) configured to cool the light source 7. The temperature control circuit is the drive circuit 82 configured to control the drive power supplied to the cooler (fan 80). The cooler (fan 80) has the cooling capacity increasing with an increase in the magnitude of the drive power. The temperature control circuit is configured to, in the process (temperature decreasing process), increase the drive power.

According to the sixth feature depending on the fifth feature, the temperature control circuit is configured to, in the process (temperature decreasing process), determine the drive power according to the magnitude of the increase rate.

According to the seventh feature depending on the sixth feature, the temperature control circuit is configured to, in the process (temperature decreasing process), increase the drive power as the increase rate increases.

Furthermore, the lighting device of the present embodiment includes the following eighth and ninth features. Besides, the eighth and ninth features are optional.

According to the eighth feature depending on any one of the first to seventh features, the power supply circuit 4 is configured to regulate the magnitude of the operation power to the desired value to turn on the light source 7. The temperature control circuit is configured to determine the criterion value according to the desired value.

According to the ninth feature depending on the eighth feature, the temperature control circuit is configured to decrease the criterion value as the desired value decreases.

Moreover, the lighting device of the present embodiment includes the following tenth to twelfth features. Besides, the tenth to twelfth features are optional.

According to the tenth feature depending on any one of the first to seventh features, the temperature control circuit is configured to calculate the required time T1 necessary for the detection temperature to reach the second threshold from the first threshold when supply of the operation power from the power supply circuit 4 to the light source 7 is started. The temperature control circuit is configured to determine that the increase rate exceeds the criterion value when the required time T1 is not greater than the predetermined criterion time T0.

According to the eleventh feature depending on the tenth feature, the power supply circuit 4 is configured to regulate the magnitude of the operation power to the desired value to turn on the light source 7. The temperature control circuit is configured to increase the criterion time T0 as the desired value decreases.

According to the twelfth feature depending on the tenth feature, the power supply circuit 4 is configured to regulate the magnitude of the operation power to the desired value to turn on the light source 7. The temperature control circuit is configured to decrease the difference between the first threshold and the second threshold as the desired value decreases.

Additionally, the lighting device of the present embodiment includes the following thirteenth and fourteenth features. Besides, the thirteenth and fourteenth features are optional.

According to the thirteenth feature depending on any one of the first to twelfth features, the light source 7 includes the substrate P1 on which the solid state light emitting device is mounted. The temperature detection circuit 5 is mounted on the substrate P1.

According to the fourteenth feature depending on any one of the first to thirteenth features, the temperature control circuit 5 is configured to measure the surrounding temperature by use of a thermosensitive device having a characteristic value varying with a temperature thereof.

As described above, according to the lighting device of the present embodiment, the temperature controlling means performs the temperature control on the solid state light emitting device based on the increase rate of the detection temperature. As a result, the temperature controlling means can detect the abnormality of the detection temperature at the initial stage in an increase in the temperature of the solid state light emitting device, and then decrease the temperature of the solid state light emitting device. Consequently, the lighting device of the present embodiment can suppress an increase in the temperature of the solid state light emitting device to avoid that the temperature of the solid state light emitting device exceeds the allowable temperature.

Figure 28:
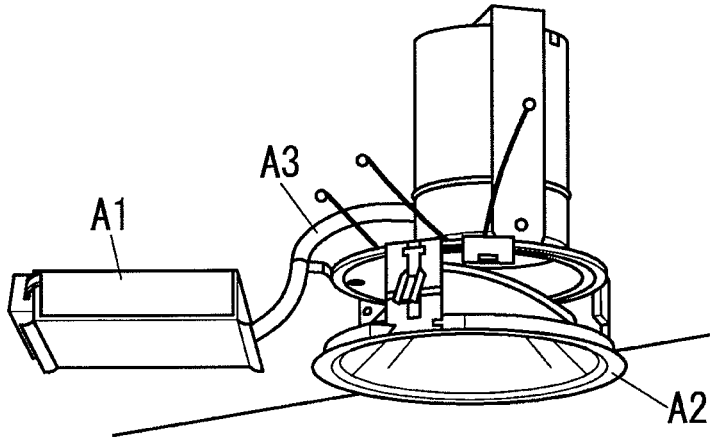
FIG. 28 is a schematic diagram illustrating an embodiment of a lighting fixture in accordance with the present invention.
Figure 29:
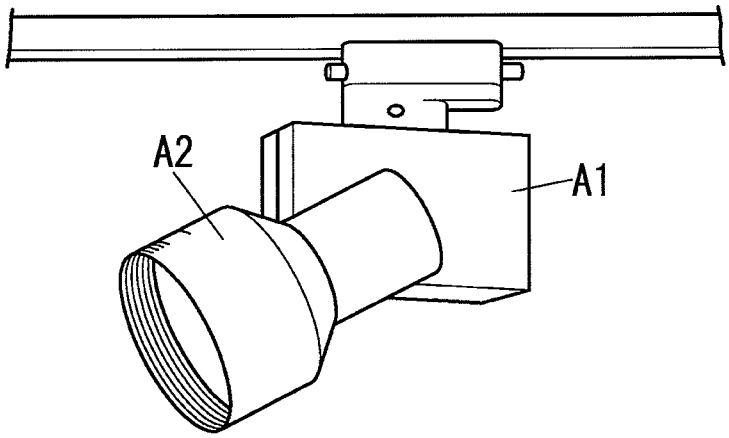
FIG. 29 is a schematic diagram illustrating another embodiment of a lighting fixture in accordance with the present invention.
Figure 30:
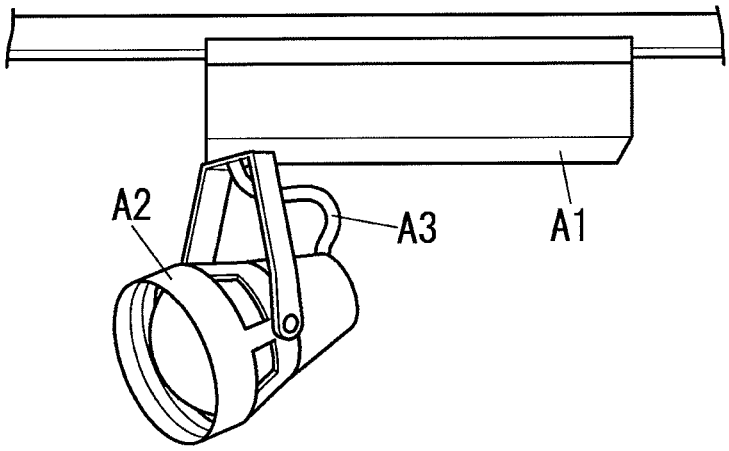
FIG. 30 is a schematic diagram illustrating another embodiment of a lighting fixture in accordance with the present invention.

The lighting device of the present embodiment is available for lighting fixtures shown in FIGS. 28 to 30, for example.

Each of the lighting fixtures illustrated in FIGS. 28 to 30 includes a lighting device A1 of the present embodiment and a fixture body A2 configured to hold the light source 7. In brief, each lighting fixture includes the fixture body A2 configured to hold the light source 7 and the lighting device A1 for operating the light source 7. The lighting device A1 has the aforementioned first feature. Note that, the lighting device A1 may have at least one of the aforementioned second to fourteenth features, if needed.

Note that, the lighting fixture shown in FIG. 28 is a down light, and the lighting fixtures shown in FIGS. 29 and 30 are spot lights. In the lighting fixtures shown in FIGS. 28 and 30, the lighting device A1 is connected to the light source 7 through a cable A3.

The aforementioned lighting fixture includes the lighting device A1 and therefore can produce the same effect as the lighting device A1 of the present embodiment. Note that, the lighting fixture described above may be used alone but a plurality of lighting fixtures described above may be used to constitute a lighting system.

The invention claimed is:

1. A lighting device, comprising:

a power supply circuit configured to supply operation power to a light source including a solid state light emitting device;

a temperature detection circuit configured to measure a surrounding temperature of the light source and output the measured surrounding temperature as a detection temperature; and a temperature control circuit configured to determine whether an increase rate of the surrounding temperature exceeds a predetermined criterion value, and, when determining that the increase rate exceeds the criterion value, perform a process of decreasing a temperature of the light source, wherein the temperature control circuit is configured to:

calculate, as required time necessary for the detection temperature to reach a second threshold from a first threshold, a time difference between a first time point at which the detection temperature reaches to the first threshold and a second time point at which the detection temperature reaches to the second threshold, when supply of the operation power from the power supply circuit to the light source is started; and determine that the increase rate exceeds the criterion value when the required time is not greater than predetermined criterion time.

2. The lighting device according to claim 1, wherein:

the temperature control circuit is a control circuit configured to control the power supply circuit; and the temperature control circuit is configured to, in the process, decrease the operation power.

3. The lighting device according to claim 2, wherein the temperature control circuit is configured to, in the process, determine the operation power according to a magnitude of the increase rate.

4. The lighting device according to claim 3, wherein the temperature control circuit is configured to, in the process, decrease the operation power as the increase rate increases.

5. The lighting device according to claim 1, further comprising a cooler configured to cool the light source, wherein:

the temperature control circuit is a drive circuit configured to control drive power supplied to the cooler;

the cooler has cooling capacity increasing with an increase in a magnitude of the drive power; and the temperature control circuit is configured to, in the process, increase the drive power.

6. The lighting device according to claim 5, wherein the temperature control circuit is configured to, in the process, determine the drive power according to a magnitude of the increase rate.

7. The lighting device according to claim 6, wherein the temperature control circuit is configured to, in the process, increase the drive power as the increase rate increases.

8. The lighting device according to claim 1, wherein:

the power supply circuit is configured to regulate a magnitude of the operation power to a desired value to turn on the light source; and the temperature control circuit is configured to determine the criterion value according to the desired value.

9. The lighting device according to claim 8, wherein the temperature control circuit is configured to decrease the criterion value as the desired value decreases.

10. The lighting device according to claim 1, wherein:

the power supply circuit is configured to regulate a magnitude of the operation power to a desired value to turn on the light source; and the temperature control circuit is configured to increase the criterion time as the desired value decreases.

11. The lighting device according to claim 1, wherein:

the power supply circuit is configured to regulate a magnitude of the operation power to a desired value to turn on the light source; and the temperature control circuit is configured to decrease a difference between the first threshold and the second threshold as the desired value decreases.

12. The lighting device according to claim 1, wherein the light source includes a substrate on which the solid state light emitting device is mounted; and the temperature detection circuit is mounted on the substrate.

13. The lighting device according to claim 1, wherein the temperature control circuit is configured to measure the surrounding temperature by use of a thermosensitive device having a characteristic value varying with a temperature thereof.

14. A lighting fixture, comprising:

a fixture body configured to hold a light source; and a lighting device according to claim 1, for operating the light source.

* * * * *